United States Patent [19]

Dufrasnes

[11] Patent Number: 4,638,127

[45] Date of Patent: Jan. 20, 1987

[54] ELECTRICAL CONTACTS FOR OSCILLATING YOKE OF LOAD SELECTOR

[75] Inventor: Jean-Claude Dufrasnes, Couillet, Belgium

[73] Assignee: Ateliers de Constructions Electriques de Charleroi (ACEC) Societe Anonyme, Brussels, Belgium

[21] Appl. No.: 772,686

[22] Filed: Sep. 5, 1985

[30] Foreign Application Priority Data

Sep. 5, 1984 [EP] European Pat. Off. ..... 84201272

[51] Int. Cl.[4] ..... H01H 1/16

[52] U.S. Cl. ..... 200/11 K; 200/11 TW; 200/240

[58] Field of Search ..... 200/2, 8 R, 8 A, 9, 200/11 B, 11 TC, 277, 237–252, 11 K

[56] References Cited

U.S. PATENT DOCUMENTS 1,248,787 12/1917 Backscheider ..... 200/277 X 2,521,521 9/1950 Johnson ..... 200/277 X 4,356,359 10/1982 Dufrasnes et al. ..... 200/11 TC

FOREIGN PATENT DOCUMENTS 0029467 6/1981 European Pat Off. .

*Primary Examiner*—J. R. Scott

*Attorney, Agent, or Firm*—Schwartz, Jeffery, Schwaab, Mack, Blumenthal & Evans

[57] ABSTRACT

Each swiveling yoke (3) of a movable element 1 includes a stem 16 concentric with a shaft 6 around which moves the swiveling yoke 3 and connecting the two arms 17 between which a roller 4 is free to rotate about a shaft 11; the outer surface of the stem 16 acts as a friction surface for a friction piece 18 comprising an elastic blade 19, a bead 20 made of a good electrically conducting material and a cable 27 connected by a cable terminal 26. The elastic blade 19 rests on two cross-pins 22 and 24 inserted into insulating plates 23.

5 Claims, 3 Drawing Figures

ELECTRICAL CONTACTS FOR OSCILLATING YOKE OF LOAD SELECTOR

BACKGROUND OF THE INVENTION

1. Field of the Invention

The present invention concerns a movable selector element mounted within an electrical apparatus comprising a series of voltage outputs connected to an electrical step transformer. In such apparatus, the movable contacts of the selector element cooperate with fixed contacts connected to the voltage outputs.

2. Related Art

The European patent No. 0029467 describes a movable selecting linkage consisting of one central and two end yokes. In this patent, the central yoke is telescopic and carries the principal movable contacts. Each end yoke swivels and supports the auxiliary movable contacts. The main and auxiliary movable contacts are in the form of rollers located alone or in parallel between the two arms of their respective yoke. For the swiveling yokes, the continuity of the electric circuit between the elements driven into relative motion is provided in conventional manner by elastic rings made of a good electrical conducting material.

In such an assembly, the number of stacked elastic rings varies as a function of the mechanical loading to be applied. However, considering the dimensional deviations occurring in assembly, it is often difficult in practice to maintain the intended mechanical loading. Inadequate loading results in microwelds from electric arcing. Excessive loading leads to premature wear and even to shearing the corrugated ring with attending danger of large damages to the apparatus from debris dispersion. On the other hand, the use of this technique to assure the continuity of the electric circuit between the swiveling yoke and the voltage output is delicate because, depending on the mechanical loading of the elastic disks made of an good electrical conducting material, the yoke motion may be slowed down and thereby affect the sharpness of the break of the auxiliary contacts.

OBJECTS AND SUMMARY OF THE INVENTION

The present invention remedies these drawbacks by separating the functions into current conduction and application of the mechanical stress, and by a greater possibility in regulating the applied loading.

The invention is characterized by a swiveling yoke with a cylindrical surface against which rests a good electrical conducting element by means of a mechanical load from an electrically insulated spring device.

BRIEF DESCRIPTION OF THE DRAWINGS

This invention is illustrated with the aid of FIGS. 1–3 as described below.

DETAILED DESCRIPTION OF THE INVENTION

Figure 1:
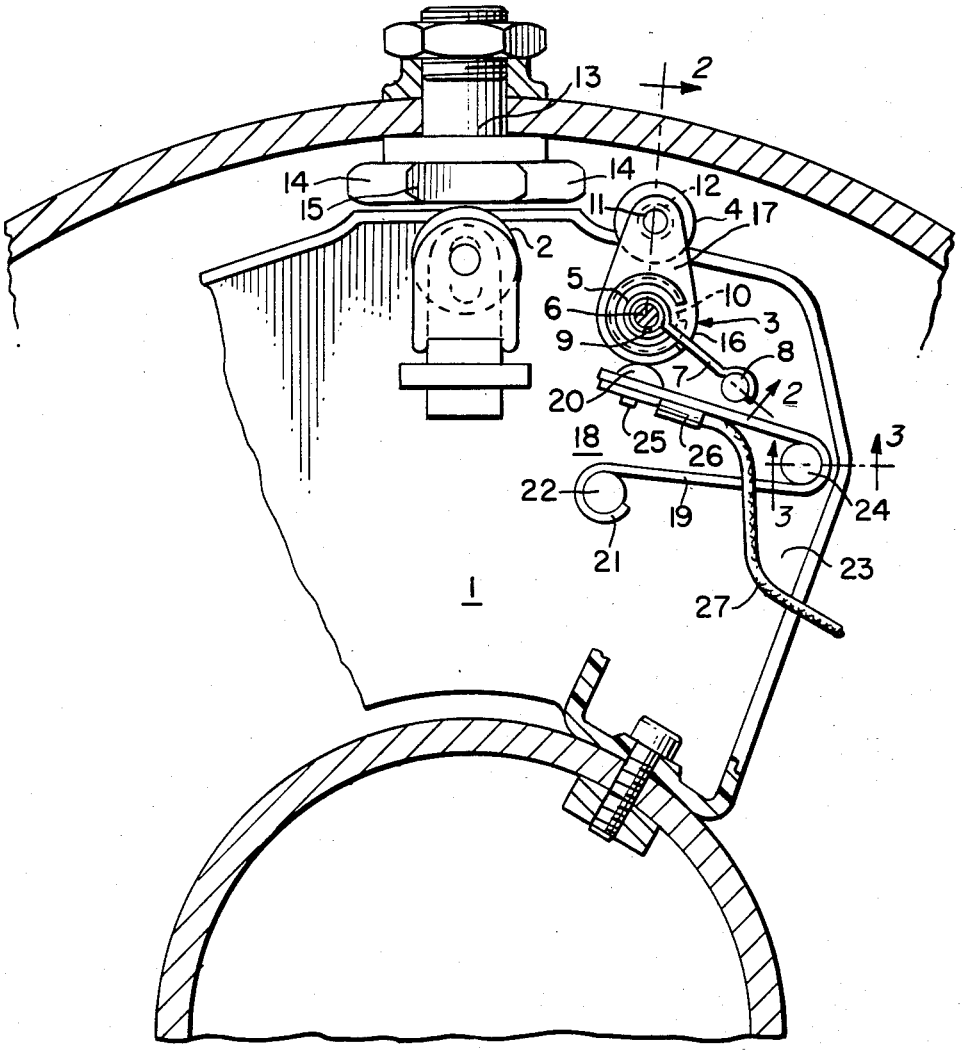
FIG. 1 is a partial top view of the auxiliary contact assembly.

FIG. 1 schematically shows the movable linkage 1 of which the telescoping yoke assembled to the center is shown by a roller 2 acting as the main contact and of which the two swiveling yokes, symmetrically arranged with respect to the main contact, are shown by a swiveling yoke 3 supporting a roller 4 acting as the auxiliary contact.

The swiveling yoke 3 is kept in its rest position by return springs 5 which are concentric to a shaft 6 about which the yoke 3 swivels. Each spring 5 terminates at one end by a horizontal vertical strand 7 resting on a stud 8 and at the other end by a vertical strand 9 inserted into a hole of a coupling sleeve 10. Each roller 4 acting as an auxiliary contact is mounted on a shaft 11 and is insulated therefrom by an insulating tube 12.

When stopped, the roller 2 in its function as the main contact cooperates with a fixed contact 13 formed from a track arranged at the center of the height, termed the central track 14, and of a large size which is located between two shorter tracks 15. The tracks 14 and 15 of the fixed contact 13 at each end are provided with an inclined plane facilitating the roller passage when the movable selecting linkage 1 is displaced. The swiveling yoke 3 is provided at its center with a stem 16 joining the yoke arms 17 to each other. The stem 16 cross-sectionally is half an annulus to allow housing the return springs 5 and the connecting sleeve 10. The outer surface of the stem 16 is concentric with the shaft 6 and acts as a friction surface for a friction piece 18 comprising an elastic blade 19 of which one end supports a bead 20 of a good electrical conducting material capable of cooperating with the friction surface of the stem 16.

The other end of the elastic blade 19 forms a loop 21 hooked into a cross-pin 22 inserted into the insulating plates 23 of the movable linkage.

Figure 2:
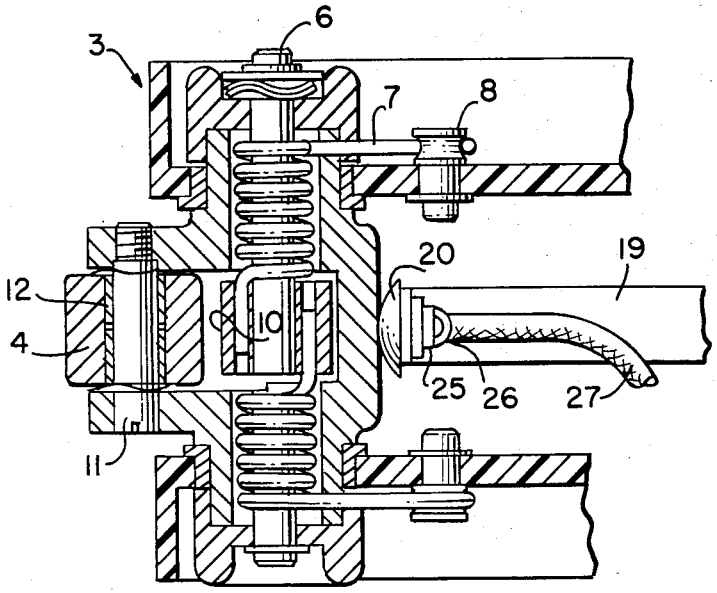
FIG. 2 is a sectional view taken along line 2—2 of FIG. 1.

In the illustrative embodiment shown in FIGS. 1 and 2, the elastic blade 19 assuming the overall shape of a hair pin rests at its center against a crosspin 24 which is also inserted into the insulating plates 23. The bead 20 generally in the shape of a spherical tip is fixed to the elastic blade 19 by a rivet 25 that further fixes in place a cable terminal 26 at the end of the cable 27 serving to carry the current to a voltage output (not shown).

When in the course of operation the movable linkage 1 is displaced, the roller 4 acting as the auxiliary contact enters the central track 14 at its inclined plane. If, for example, the movable linkage 1 is moved to the left, then as the central track 14 of the fixed contact 13 is being entered, the pivoting yoke 3 swivels about its shaft 6 in a clockwise manner to allow the roller 4 to roll onto the track 14.

The motion of the movable linkage 1 continues and thereby the roller 4 departs the track 14 at its left end and under the action of the return springs 5 of the swiveling yoke 3 resumes its rest position after having pivoted about its shaft 6 in the counter-clockwise direction.

While the roller 4 of the swiveling yoke 3 and the track 14 of the fixed contact 13 are functioning together, the current is conducted from the roller 4 towards the arm 17 of the swiveling yoke 3 by means of the electrically conducting elastic washers and then from the swiveling yoke 3 through the stem 16, the bead 20, the cable terminal 26 and the cable 27 to the voltage output. Taking into account that the cross-pins 22 and 24 are inserted into insulating plates 23, the current-conduction function and the mechanical-load function for the friction piece 18 are separated; the elastic blade 19 assures there will be mechanical loading, while the bead 20, the cable terminal 26 and the cable 27 assure current conduction. The elastic blade 19 is suitably positioned between the plates 23 by means of a clearance suitably fashioned into each of the cross-pins 22 and 24.

Figure 3:
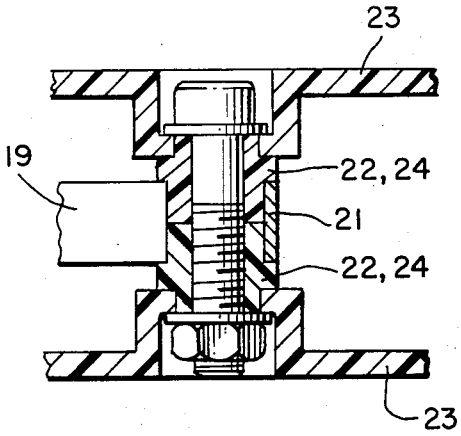
FIG. 3 is a sectional view taken along line 3—3 of FIG. 1.

FIGS. 1 and 3 illustrate the details of the spring blade, insulating plate and the cross-pins.

In order to avoid deformation of the loop 21 fashioned at one end of the elastic blade 19, the cross-pin 22 or 24 may be made of two parts each, slipping each from its side into the loop 21 and connected to each other by known fastener means.

I claim:

1. An electrical contact assembly comprising: a swiveling yoke mounted on a movable linkage, at least one roller cooperating with fixed contacts, said swiveling yoke having a return spring exerting a pivotal biasing force on said roller when said roller engages and rotates on each of said fixed contacts, said swiveling yoke having a cylindrical surface, an electrical conducting element connected to a voltage output and biased against said cylindrical surface by a mechanical force from a spring means.

2. An electrical contact assembly according to claim 1, wherein said spring means is an elastic blade resting on at least one electrically insulated support cross-pin of said movable linkage.

3. An electrical contact assembly to claim 2, wherein said electrically conducting element is a bead rigidly joined to the elastic blade and to a cable terminal at one end of a cable, the other end of which is connected to the voltage output.

4. An electrical contact assembly according to claim 2 wherein the elastic blade ends in an almost closed loop kept in place by another electrically insulated cross-pin.

5. An auxiliary contact assembly comprising:

(a) a shaft, (b) a conductive stem having an outer surface thereon rotatably mounted on said shaft, (c) a pair of yoke arms on said stem, (d) a conductive roller mounted between said arms, (e) a return spring acting on said stem, (f) a friction piece including an elastic blade with a conducting element thereon, said conducting element being biased by said elastic blade into contact with said outer surface, (g) a pair of stationary cross-pins, said elastic element surrounding a portion of each cross-pin.

* * * * *